United States Patent [19]

Nix

[11] 3,984,103

[45] Oct. 5, 1976

[54] MATCHED GOLF CLUB SET

[76] Inventor: Jack W. Nix, 1800 Quiet Lane SW., Albuquerque, N. Mex. 87501

[22] Filed: Mar. 4, 1975

[21] Appl. No.: 555,287

Related U.S. Application Data

[63] Continuation-in-part of Ser. No. 492,903, July 29, 1974, abandoned.

[52] U.S. Cl. ..... 273/77 A

[51] Int. Cl.[2] ..... A63B 53/00

[58] Field of Search ..... 273/77 A, 80 R, 79, 273/80.1, 167–175

[56] References Cited

UNITED STATES PATENTS

| | | | |
|---|---|---|---|
| 1,516,786 | 11/1924 | Prentiss | 273/77 A |
| 1,529,959 | 3/1925 | Martin | 273/79 |
| 1,594,801 | 8/1926 | Stackpole | 273/77 A |
| 1,665,523 | 4/1928 | Boyce | 273/79 |
| 1,993,928 | 3/1935 | Glover | 273/79 |
| 2,138,294 | 11/1938 | Douglas | 273/79 |
| 2,175,598 | 10/1939 | Fedak | 273/79 |
| 2,336,405 | 12/1943 | Kent | 273/79 |
| 2,447,967 | 8/1948 | Stone | 273/77 A |
| 2,705,147 | 3/1955 | Winter | 273/79 |
| 3,266,805 | 8/1966 | Bulla | 273/77 A X |
| 3,655,188 | 4/1972 | Solheim | 273/77 A |
| 3,848,737 | 11/1974 | Kenon | 273/77 A X |
| 3,871,649 | 3/1975 | Kilshaw | 273/77 A |

*Primary Examiner*—Richard J. Apley
*Attorney, Agent, or Firm*—Henry Heyman

[57] ABSTRACT

A set of golf clubs in which all the clubs fall into two classes, namely irons and woods, and in which at least all of the clubs in a class have equal shaft length, equal lie angle, equal swing weight and equal total weight. Both irons and woods could be so constructed as to have these equal parameters.

4 Claims, 2 Drawing Figures

(OLD ART)

MATCHED GOLF CLUB SET

This application is a continuation-in-part of application Ser. No. 492,903 filed 7/29/1974 now abandoned.

BACKGROUND OF THE INVENTION

The art of golf club making involves a sophisticated plurality of variables. Some of the variables are correlated or matched. By a matched set of clubs is meant that the woods and irons are of a specific swing weight, the shaft lengths are graduated and there is uniformity in the flexibility of the shafts.

The graduated lengths of the clubs of the prior art generally requires that the total weights of the clubs vary in order to obtain equal swing weights. The effect of different shaft lengths and weights of the clubs is a multitude of different sets of body controls for the player to learn in the attainment of consistent effective hitting.

The reasons why it is so difficult to train the body of the player to swing each club so as to hit the ball squarely in the selected direction are numerous, but some of the reasons are subject to analysis with the result that a more controllable set of golf clubs can be provided.

The desirability of matched swing weight requires that there be correlation of shaft length with head weight and loft angles. In such matched or correlated golf clubs, the length of the shaft decreases with increasing loft with the result that the swing becomes tighter and more upright for short clubs, particularly the irons, requiring the player to stand closer to the ball. On page 19, in paragraph 8, of the book "Power Golf", written by Ben Hogan, and published by A. S. Barnes & Company, New York, N.Y., copyrighted in 1945, it is stated that there are as many positions for the feet as there are clubs in the bag.

In order to hit a golf ball with accuracy in direction, distance and loft, the golf club head must be moved in a controlled arc that will bring it against the ball at the most effective striking angle with a velocity related to the desired distance the ball is to travel.

The plane of the arc through which the golf club is moved is at an acute angle with the axis of the player's body. To the end that the radius of arc of club motion, and the plane of motion will be constant throughout the swing, it is required that the player develop a smooth rhythmical flowing of hands, body and legs, all working in unison. The motion is so intricate that the greater part of the golfer's training is in swing control. For example, in the book, "Fundamentals of Golf" by Dow Finsterwald, printed by The Ronald Press Company, New York, N.Y., copyright 1961, fifteen pages are devoted solely to the aspects of body control involved in the swing.

It follows that if each club has a different shaft length, the plane of the arc swing will be unique for each club. Consequently, the player must develop a different strict body control discipline for each club, a matter of fourteen accommodations for a complete set of fourteen clubs, not counting the putter.

SUMMARY OF THE INVENTION

The golf clubs of this invention are designed to be in sets of two classes, that is, woods and irons, with all the clubs in a class having equal lengths and equal lie angle. The equalities are desirably the same for both classes of clubs, but may be different if so desired by the user. The advantages of golf clubs constructed in accordance with this invention are that the player can concentrate the training of his body and hands in developing the swing through only one plane of arc for only one class of clubs. Further, only one distance between feet and ball need be learned, grip control to keep the plane of the club striking face normal to the arc of swing is simplified and constant. The somewhat awkward swing angle for the short clubs of the conventional set, such as the number 9 iron, is avoided. The criticality in position of club at moment of impact with the conventional long clubs like the number 1 wood or iron is reduced. This is because in the conventional clubs, the lie angle becomes more acute as the club becomes longer with the result that club head must make a grazing sweep with the ground at the bottom of the swing and this situation is obtainable only with exacting control of the plane of swing.

The golf clubs of the present invention are advantageous over prior art clubs in that the player can become skilled in a shorter time and to a greater degree in obtaining the control necessary to hit the golf ball squarely and with requisite impact. The ultimate simplicity in attaining control is to have clubs of both classes of the same length and lie because the player can concentrate on one arc of swing, one wrist and grip control and one set of coordinate movements of shoulder, arm, hip and knee.

The prior art of conventional golf clubs is comprehensively described in Section IV of the "Encyclopedia of Golf", Copyright 1870, published by Harper & Row, New York, N.Y.

The Rules of the United States Golf Association and the Royal and Ancient Golf Club of St. Andrews, Scotland pertaining to specifications of permissible golf clubs are set forth on page 303 and 304 of the above referenced Encyclopedia. These rules require that the "golf club shall be composed of a shaft and head, and all of the various parts must be fixed so that the club is one unit; the club shall not be designed to be adjustable".

While adjustability of loft angle in golf clubs might incidentally result in clubs of the same shaft length and lie, this approach to a set of simplified clubs is not feasible. The club head of a golf club during a power swing reaches a velocity in excess of 150 miles per hour. Therefore, while golf clubs of adjustable loft angle originated for the purpose of reducing the number of clubs needed to be carried have been suggested in the prior art, the result may be a lethal instrument which has not been found acceptable because it is dangerous and because of the deleterious effect on the desired condition of shaft axis with club head impact zone.

Accordingly, it is a prime objective of the present invention to provide a set of golf clubs which have all the desirable characteristics of the prior art golf clubs and which, in addition, are provided with equal length and lie angle to reduce the complications facing the non-expert golfer in learning to acquire the desired skill.

It is a further object of the present invention to provide a set of golf clubs consisting of two classes of clubs, to wit, irons and woods, in which all of the clubs in a class have equal length and equal lie.

It is still another object to provide a set of golf clubs comprising "irons" in which all clubs have equal length, and equal lie angle.

It is another object of this invention to provide a set of golf clubs comprising "woods" in which all clubs are of equal length and equal lie angle.

Another object of this invention is to provide a matched set of golf clubs, the individual clubs of which fall into two classes known as "irons" and "woods" and in which all the clubs of at least one class have equal shaft length, equal lie angle, equal swing weight and equal total weight.

It is still another object of this invention to provide golf clubs, both woods and irons in which all clubs have equal length, and equal lie angle.

Other objects and advantages will become apparent to the reader with a reading of the following description with reference to the drawing.

DESCRIPTION OF THE PREFERRED EMBODIMENT

Figure 1:
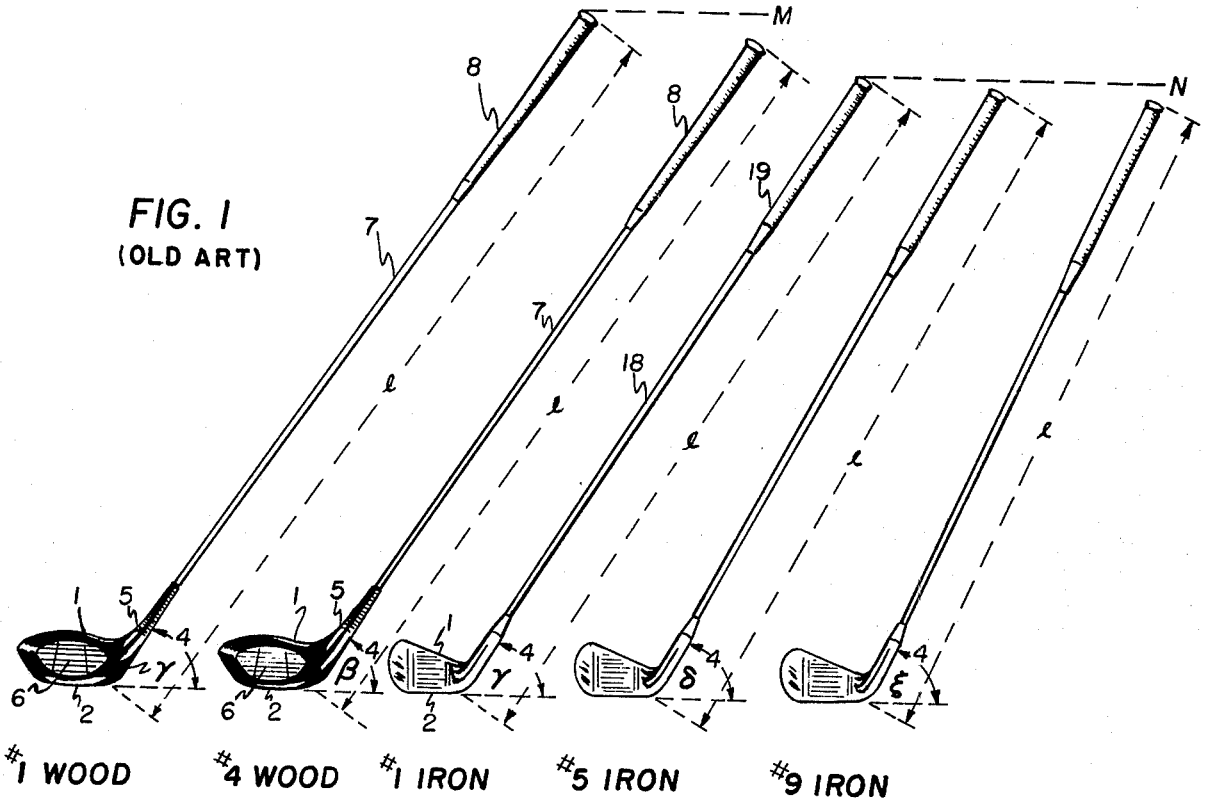
FIG. 1 shows a side view of Nos. 1 and 4 woods, and Nos. 1, 5 and 9 irons to represent as examples, the gradations in shaft length, and lie angle of a prior art set of clubs.
Figure 2:
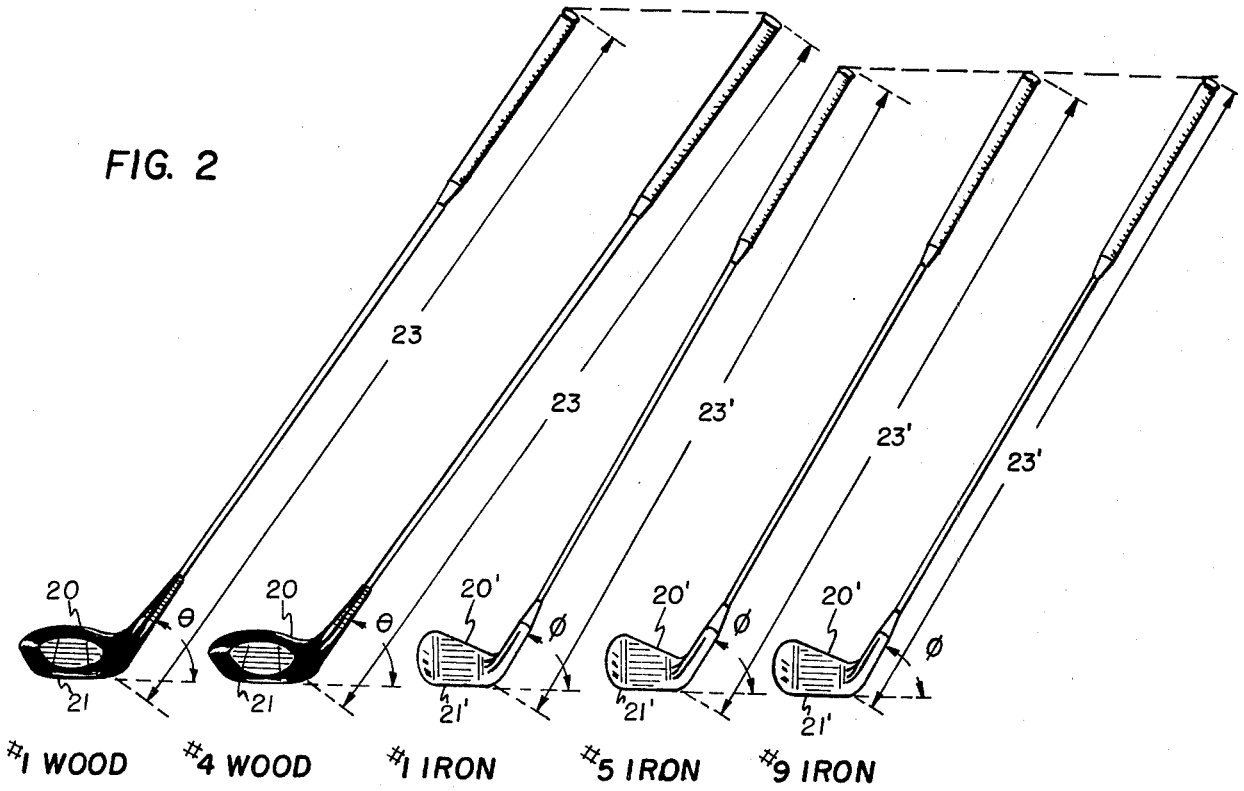
FIG. 2 shows a side view of Nos. 1 and 4 woods and Nos. 1, 5 and 9 irons, representative of all clubs in a set and constructed in accordance with the present invention.

Although a complete set of golf clubs may have as many or more than six woods and eleven irons, the illustration in the drawings, FIG. 1, show a few selected ones of such clubs to represent progressive change between all the clubs of a prior art set and in FIG. 2, the simplification of all the clubs in a set by the present invention. Inasmuch as the loft angles of the clubs of the present invention are consistent with prior art clubs, a frontal view of the clubs is not shown.

While the average shaft length, total weight, swing weight, loft angle and lie angle may vary slightly in sets of different manufacture, a set of actual values of prior art clubs are reproduced in Table 1, below:

TABLE 1

(Prior Art)

| WOODS | Length (inches) | Total Weight (ounces) | Swing Weight (ounces) | Lie (Degrees) | Loft (Degrees) |
|---|---|---|---|---|---|
| No. 1 | 43 | 13.1 | 20.5 | 55 | 10 |
| No. 2 | 42½ | 13.3 | " | 55¼ | 13 |
| No. 3 | 42 | 13.5 | " | 55½ | 16 |
| No. 4 | 41½ | 13.7 | " | 55¾ | 19 |
| IRONS | | | | | |
| No. 1 | 39 | 15.2 | 21.6 | 59 | 18 |
| No. 2 | 38½ | 15.4 | " | 58 | 22 |
| No. 3 | 38 | 15.6 | " | 59 | 26 |
| No. 4 | 37½ | 15.8 | " | 60 | 30 |
| No. 5 | 37 | 16.0 | " | 61 | 34 |
| No. 6 | 36½ | 16.2 | " | 62 | 38 |
| No. 7 | 36 | 16.4 | " | 63 | 42 |
| No. 8 | 35½ | 16.6 | " | 64 | 46 |
| No. 9 | 35 | 16.8 | " | 65 | 50 |

The characteristics of a set of clubs produced in accordance with the present invention is as follows:

TABLE 2

| WOODS | (Length (inches) | Total Weight (ounces) | Swing Weight (ounces) | Lie (Degrees) | Loft (Degrees) |
|---|---|---|---|---|---|
| No. 1 | 42 | 13.5 | 20.5 | 55½ | 10 |
| No. 2 | " | " | " | " | 13 |
| No. 3 | " | " | " | " | 16 |
| No. 4 | " | " | " | " | 19 |
| IRONS | | | | | |
| No. 1 | 37 | 16.0 | 21.6 | 61 | 18 |
| No. 2 | " | " | " | " | 22 |
| No. 3 | " | " | " | " | 26 |
| No. 4 | " | " | " | " | 30 |
| No. 5 | " | " | " | " | 34 |
| No. 6 | " | " | " | " | 38 |
| No. 7 | " | " | " | " | 42 |
| No. 8 | " | " | " | " | 46 |
| No. 9 | " | " | " | " | 50 |

Referring to FIG. 1 and Table 1, it is seen that each club, whether a wood or iron, is different in length and lie angle from every other club. Length of club and lie angle necessarily vary together because the longer the club, the more the plane of swing moves from the vertical to the horizontal. The sole of the club is parallel to the earth at the bottom of the swing, hence the lie angle, which is the angle between the back of the club shaft and a backward straight line projection of the club head sole, becomes less as the club length gets longer. FIG. 1 shows the shaft lengths and lie angles of wood clubs numbers 1 and 4 and iron clubs 1, 5 and 9.

Reference numeral 1 refers generally to the head of the club in FIG. 1. Numeral 2 refers to the sole of the club head. A line projected backward from the sole forms an angle generally indicated by reference numeral 4 with the shaft axis known as the lie angle or lie. The lie angle 4 is unique in value for each club of the prior art. The unique values are indicated by the Greek letters $\alpha$, $\beta$, $\gamma$, $\delta$ and $\epsilon$. Lie angle $\alpha$ of the No. 1 wood is 55° and lie angle $\beta$ of the No. 4 wood is 55¾ degrees. The length $l$ of the No. 1 wood is 43 inches whereas the length $l$ of the No. 4 wood is 41½ inches. The length $l$ of the irons and corresponding lie angles $\gamma$, $\delta$ and $\epsilon$ gradate respectively from 39", 57° to 35", 65° for irons No. 1 and No. 9. Intermediate gradations are shown in Table 1. The loft angles are conventional and are also given in Table 1. Each club of the prior art has a length designated generally by $l$ in FIG. 1 and the length of any club is different from the length of every other club. This difference in length is made more apparent by the dashed horizontal line M projecting from the shaft end of the No. 1 WOOD and the dashed horizontal line N projecting from the shaft end of the No. 1 IRON.

It is customary for all the irons in a set and all the woods in a set to be matched; that is, to have the same swing weight. According to the referenced Encyclopedia of Golf, page 221, swing weight by definition "is the weight which the golfer feels in the head of the club when he swings it. That is, the swing weight indicates the distribution of the weight of a club. It is the proportion of the weight in the head compared to the shaft and grip, and it is most commonly measured on a scale called the "lorythmic scale." This scale measures the excess cantilever moment of the head end of the club over the grip end when the grip end is clamped in a balance scale. Such a scale and measuring technique is described on page 223 of the referenced Encyclopedia of Golf.

Referring again to Table 1, it is seen that although total weights of the clubs, both woods and irons, are graduated, yet the swing weights are the same for woods and for irons. It follows that if swing weight is to be a constant, the total weight of the shorter clubs must be heavier.

Referring to FIG. 2 which shows representative golf clubs of the present invention, No. 1 and No. 4 woods are illustrated to show the limits of gradation through woods Nos. 1, 2 3 and 4. The woods have a head shown generally by reference numeral 20, a sole 21, lie angle $\theta$ and overall length 23. In accordance with the present invention, all wood club lengths 23 are the same and all lie angles $\theta$ are the same with values given in Table 2. The length of the clubs, of each class, is a mean value of the lengths in a conventional golf club art.

Irons Nos. 1, 5 and 9 are illustrated to show the type of uniformity of length and lie angle of all the clubs in a set. Shaft length 23' and lie angle $\phi$ are the same for all irons. The club heads are shown generally by reference numeral 20' and the sole is referred to by numeral 21'.

As a consequence of equal club length in either class of clubs, the total weight as well as the swing weight can be the same. Thus the difficulty faced by the player of learning to swing clubs of different moment of inertia is eliminated.

From the foregoing description it is seen that this invention teaches a set of correlated or matched irons and a set of woods, each club having a unique loft angle, and all clubs in a set having the same length, total weight, swing weight and lie.

It is customary and accepted in the prior art to distinguish each particular club by a number which identifies its parameters. Applicant's clubs have corresponding numbers although the significance relates only to loft angle.

What is claimed is:

1. A set of a plurality of matched and correlated golf clubs, each having a shaft and a solid unitary head immovably affixed to said shaft, comprising, a first class of a plurality of distinctively individually numbered irons and a second class of a plurality of distinctively individually numbered woods, each of said clubs having a unique loft angle different from the loft angle of other clubs and the plane of the striking face of each such club being immovably fixed relative to both the direction of elongation of the shaft and the plane of the sole of the head, the individual distinctive number of each club being an identification of the loft angle of the club and corresponds to the number of a state of the art club having the same loft angle, and at least one class of said matched and correlated golf clubs (having) consisting of golf clubs of equal length, equal total weight, equal swing weight and equal lie angle.

2. The set of a plurality of matched and correlated golf clubs of claim 1 in which the said at least one class of said set of matched and correlated golf clubs consisting of golf clubs of equal length, equal total weight, equal swing weight and equal lie angle is the first class of a plurality of distinctively individually numbered irons.

3. The set of golf clubs of claim 1 in which the said at least one class of said set of clubs is the second class of a plurality of woods.

4. The set of golf clubs of claim 1 in which the first class of a plurality of irons consists of clubs of equal length, equal total weight, equal swing weight and equal lie angle, and in which the second class of a plurality of woods consists of clubs of equal length, equal total weight, equal swing weight and equal lie angle.

* * * * *